US005943748A

United States Patent [19]

Steiner et al.

[11] Patent Number: 5,943,748

[45] Date of Patent: Aug. 31, 1999

[54] ADAPTER DEVICE FOR FIBER PROCESSING UNIT

[75] Inventors: Erwin Steiner, Clover; Rolf Mischker, Fort Mill, both of S.C.

[73] Assignee: American Suessen Corporation, Charlotte, N.C.

[21] Appl. No.: 08/929,081

[22] Filed: Sep. 15, 1997

[51] Int. Cl.[6] ..... D02G 1/12

[52] U.S. Cl. ..... 28/221; 28/258; 28/263

[58] Field of Search ..... 28/221, 220, 250, 28/258, 263, 268, 269, 270, 281

[56] References Cited

U.S. PATENT DOCUMENTS

| | | | |
|---|---|---|---|
| 2,846,729 | 8/1958 | Sonnino | 28/269 |
| 3,160,941 | 12/1964 | Williamson | 28/268 |
| 3,200,467 | 8/1965 | Iwnicki et al. | 28/250 |
| 4,075,743 | 2/1978 | Roberts | 28/263 |
| 5,467,513 | 11/1995 | Steiner et al. . | |
| 5,647,109 | 7/1997 | Steiner et al. | 28/263 |

*Primary Examiner*—John J. Calvert
*Assistant Examiner*—Larry D. Worrell, Jr.
*Attorney, Agent, or Firm*—Evenson McKeown Edwards & Lenahan, PLLC

[57] ABSTRACT

In the case of an arrangement for transporting at least one thread treated in a thread conditioning plant from a delivery roller pair to a transport belt which takes up the thread in the form of thread loops, an adapter is arranged downstream of the delivery roller pair, with which adapter it is possible to equip the arrangement as required with a stuffer box or an oscillating loop laying device. By simply exchanging an aggregate it becomes possible, depending on the type of operation required, to crimp and heat set threads or to treat uncrimped threads.

30 Claims, 5 Drawing Sheets

ADAPTER DEVICE FOR FIBER PROCESSING UNIT

BACKGROUND AND SUMMARY OF THE INVENTION

The present invention relates to an arrangement for transporting at least one thread, treated in a thread conditioning plant, from a delivery roller pair to a transport belt which takes up the thread in the form of thread loops.

In the case of a known thread conditioning plant (U.S. Pat. No. 5,467,513), which comprises a delivery roller pair and a flat transport belt, a stuffer box is replaced by an oscillating loop laying device in a single assembly modification. The ratio of the speeds between the drive of the delivery roller pair and the drive of the oscillating loop laying device is variable. It is hereby possible in the case of the known thread conditioning plant to deposit threads as required with a stronger or a weaker degree of crimping, or without any crimping at all, onto the transport belt. The patent is based on the concept that the new oscillating loop laying device renders the stuffer box superfluous and that a re-equipping, which indeed is certainly possible, is not a consideration. Experience has shown, however, that in particular in the case of coarser counts of thread, for example carpet threads, the oscillating loop laying device does not achieve the same crimping effect as the stuffer box.

It is an object of the present invention to operate the thread conditioning plant with a stuffer box or an oscillating loop laying device as required without complicated assembly and disassembly.

The object of the present invention has been achieved in that an adaptor is arranged downstream of the delivery roller pair for taking up a stuffer box or an oscillating loop laying device as required.

Differing from the known thread conditioning plant, and in accordance with the present invention, all required operational conditions are not carried out by one and the same oscillating loop laying device. Rathermore, the new thread conditioning plant permits a standard stuffer box to be used alongside the oscillating loop laying device, the latter being known for example in U.S. Pat. No. 5,647,109. In order to change over to these types of operation, a complicated modification is not necessary, rathermore, due to the presence of an adapter, one aggregate can simply be exchanged for the other, which exchange is carried out in a very short time. All advantages of the above mentioned prior art are maintained, and at the same time the advantages of the known stuffer box.

The adapter comprises advantageously a hollow cylindrical take-up surface for the stuffer box or the loop laying device. When the stuffer box and the loop laying device each comprise a cylindrical outer contour, an exchange of the two aggregates can take place particularly quickly, in particular when there is a clamping device for taking up the stuffer box or the loop laying device.

The adapter of the present invention, which adapter remains at all times in the machine, is constructed for this purpose of a plurality of parts and comprises a hollow cylindrical take-up surface comprising a tube and also a sealing extension projecting into the wedge-shaped gap of the delivery roller pair. A sealing extension of this type is present, for example, in the known stuffer box according to U.S. Pat. No. 5,647,109. In the case of the adapter of the present invention, however, the sealing extension is separated from the stuffer box and used as a component of the adapter which remains in the machine even during operation with the loop laying device.

In a further embodiment of the present invention a central drive is provided for the drive of the delivery roller pair, to which central drive also the drive of the loop laying device is connected. This means that a drive disc runs idly during stuffer box operations, whereas during operation with the oscillating loop laying device, the drive disc transmits the drive thereof.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
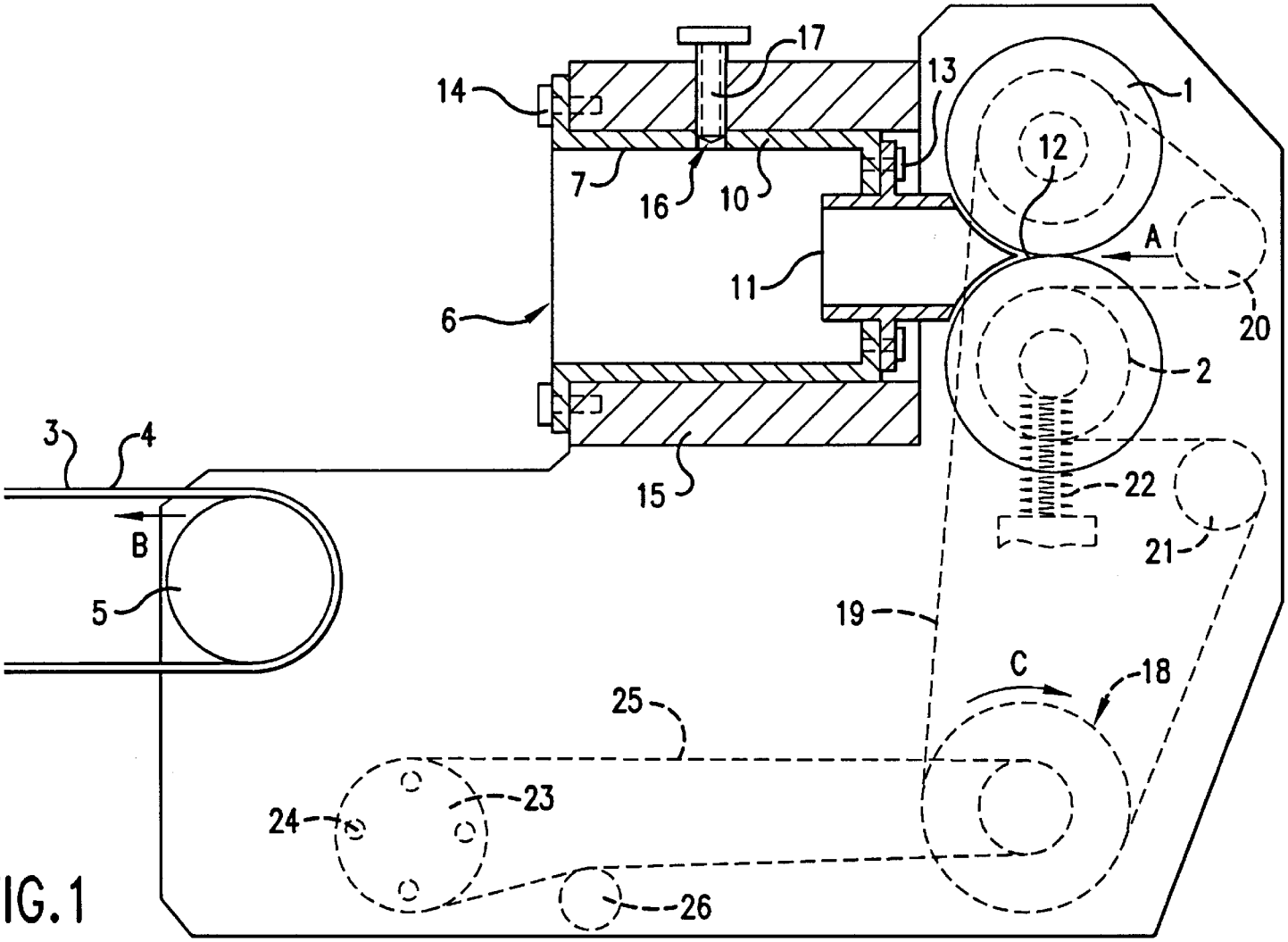
FIG. 1 is an axial section through the arrangement in the area of the adapter of the present invention, whereby the stuffer box as well as the oscillating loop laying device are currently disassembled.

The arrangement shown in FIG. 1, which is a component of a thread conditioning plant, for example for heat setting threads, serves the conveyance of at least one thread fed in arrow direction A from a delivery roller pair 1,2 to a flat transport belt 3 driven in arrow direction B. The thread (not shown) is deposited in the form of thread loops onto the transport belt 3 by devices not shown in FIG. 1 but described below, and subsequently fed for example to a heat setting chamber, which operates with superheated steam under atmospheric pressure. The transport belt 3 is therefore provided with a perforation 4, which permits the flowing through of the fluid required for heat setting. A deflecting roller 5 can be seen, to which the drive for the transport belt 3 can be connected as required.

It is often desirable to heat set threads with varying degrees of crimping as well as threads which are totally uncrimped in the same thread conditioning plant. To this end it is necessary to provide different devices between the delivery roller pair 1,3 and the transport belt 3 for conveying at least one thread to the transport belt 3. These different devices must be capable of being set to one operational mode and re-set again to another in the shortest possible time and without any complicated assembly work.

In order to make this possible, the arrangement is provided with an adapter 6 arranged downstream of the delivery roller pair 1,2, which adapter 6 can take up a known stuffer box 7 (see FIG. 2 below) or a known loop laying device 8 (see FIG. 3 below). In the case of the stuffer box 7, this may be an embodiment according to U.S. Pat. No. 5,647,109, and in the case of the loop laying device 8, this may be an embodiment according to the above mentioned U.S. Pat. No. 5,467,513.

The adapter 6, which remains constantly in the machine, is provided with a hollow cylindrical take-up surface 9, into which either a stuffer box 7 or an oscillating loop laying device 8 can be inserted. This is described below. The adapter 6 is advantageously comprised of a plurality of components, which include a tube 10 as well as a sealing extension 11. The sealing extension 11 is releasably screwed onto the tube 10 by means of connecting screws 13 and projects into the wedge-shaped gap 12 of the delivery roller pair 1,2 arranged thereto. Thus a reliable conveyance from the delivery roller pair 1,2 to the stuffer box 7 or to the loop laying device 8 is achieved. The delivery roller pair 1,2 many also be covered on the front sides by extensions of the sealing extension 11 (not shown).

The tube 10 is affixed to the machine frame 15 by means of fastening screws 14. In the center of its axial extension, the tube 10 is provided with a radial bore hole, which serves the clamping device 16 of the stuffer box 7 or the loop laying device 8~and through which a clamping screw 17 grips.

The delivery roller pair 1,2 is connected to a central drive 18, for example to the driven shaft of a gear connected to an electric motor, whereby the rotational direction of the driven shaft is denoted by C. The driving of the delivery roller pair 1,2 by the central drive 18 serves a drive belt or also a toothed belt 19, to which tension rollers 20 and 21 are arranged.

The peripheral surfaces of the delivery roller pair 1,2 can be made of steel, whereby the delivery roller 2 is constantly pressed onto the delivery roller 1 during operation by means of a pressure spring 22.

A driving pulley 23 is arranged at the loop laying device 8 in a way to be described below, which driving pulley 23 can also be connected to the central drive 18 by means of a drive belt 25. The driving pulley 23 is provided with a plurality of connection points 24 for the loop laying device 8, see FIG. 5 below. A tension roller 26 is arranged to the drive belt 25.

The deflecting roller 5 for the transport belt 3 may also be connected to the central drive 18; it has been proven practical, however, to drive the transport belt 3 separately and infinitely variable.

Figure 2:
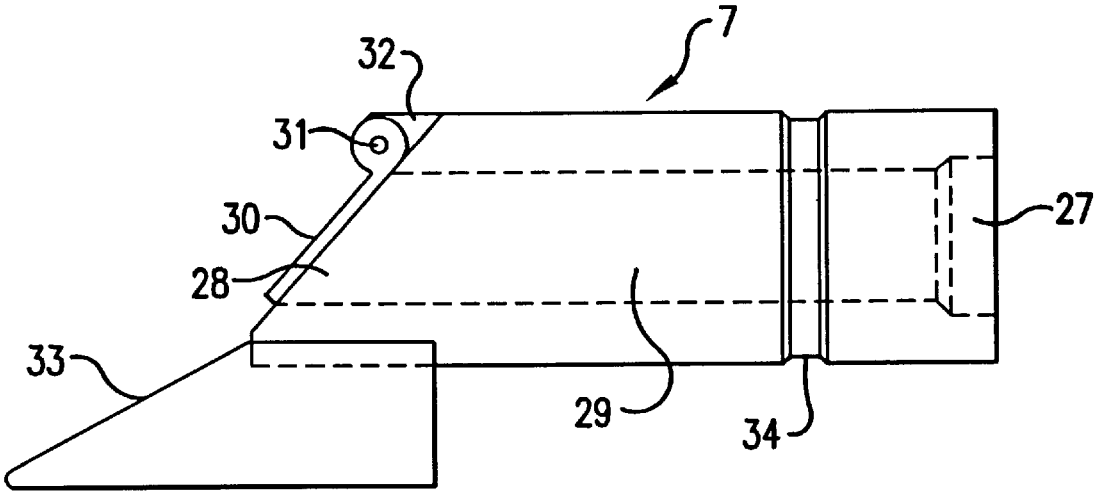
FIG. 2 is a stuffer box, which can be inserted into the adapter of FIG. 1 as required.
Figure 3:
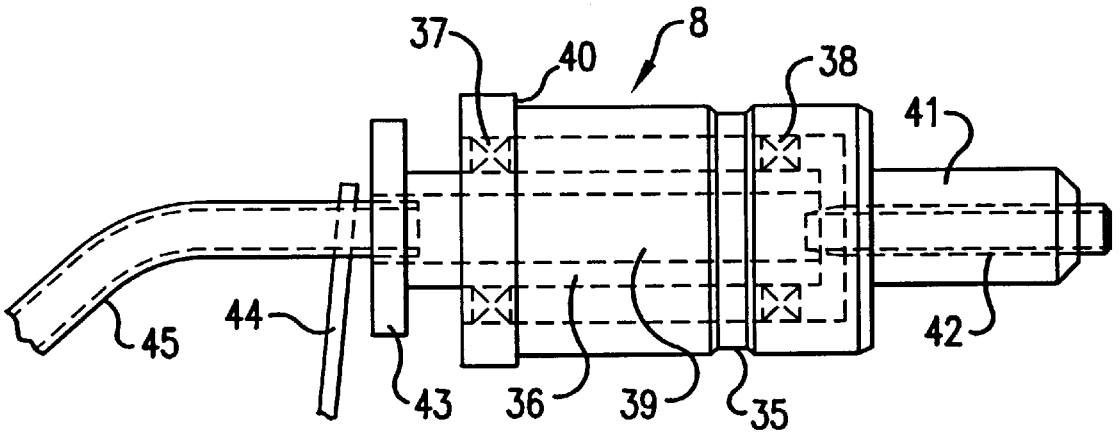
FIG. 3 is an oscillating loop laying device, which can be inserted into the adapter of FIG. 1 as required.

In FIGS. 2 and 3 the stuffer box 7 and the oscillating loop laying device 8 are each separately schematically represented.

The stuffer box 7 according to FIG. 2 comprises a through channel 29 and is bordered at its start and end by a channel entrance 27 and a channel exit 28. The through channel 29 has a constantly circular cross section with no partition seams. A so-called retarding lid 30 is arranged at the channel exit 28, which retarding lid 30 is affixed above at a joint 31 of the channel wall 32. The retarding lid 30 can exert a retarding force against the transport direction on the thread to be crimped, so that the channel exit 28 is closed when not in operation. The retarding force can be exerted by the dead weight of the retarding lid 30 or, in order to increase the crimping effect, by an additional spring (not shown).

The threads to be crimped enter, due to a relatively high delivery speed of the delivery roller pair 1,2, into the channel entrance 27 and are slowed down at the walls of the through channel 29 and by the retarding lid 30, so that the desired crimping effect of the threads is achieved. Single threads or a plurality of jointly delivered threads can hereby pass through each stuffer box 7. The crimped threads reach the transport belt 3 by means of a sliding surface 33 arranged downstream of the channel exit 28, on which transport belt 3 the threads are deposited in loops and fed to a heat setting chamber (not shown), in which the crimping is set.

As can be seen, the stuffer box 7 comprises a cylindrical outer contour, which can be inserted into the hollow cylindrical take-up surface 9 of the adapter 6. The outer contour of the stuffer box 7 comprises a ring groove 34, into which the clamping screw 17 grips after the stuffer box 7 has been inserted into the adapter 6.

The loop laying device 8, which can be alternatively inserted into the adapter 6, also comprises a cylindrical outer contour, which is provided with a ring groove 35 for the clamping device 16. The cylindrical outer contour is a component of a tube stationary during operation, in which tube a hollow shaft 36 is rotatably supported by means of antifriction bearings. The hollow shaft 36 is, however, not driven to rotate but rather to traverse motion. The axial position of the loop laying device 8 is secured in the adapter 6 by means of an axial stopper 40.

The loop laying device 8 comprises towards the delivery roller pair 1,2 a tube-like extension 41, into which an entry tube 42 is pressed. This projects into the through channel 39 and into the wedge-shaped gap 12 of the delivery roller pair 1,2.

The hollow shaft 36 is connected to a traversing disc 43, to which a traversing rod 44 is coupled, which is described below with the aid of FIG. 5. By means of the traversing disc 43, a deposit tube 45 is inserted projecting into the hollow shaft 36, which deposit tube 45 together with the hollow shaft 36 is driven to traverse motions in such a way that threads delivered by the delivery roller pair 1,2 can be deposited onto the transport belt 3 in the form of thread loops. The loop laying device 8 serves in particular the depositing of uncrimped threads or alternatively, as taught in the above mentioned U.S. Pat. No. 5,467,513, the depositing of variously crimped threads.

The adapter 6 permits, by means of a rapid exchange, the insertion of the stuffer box 7 according to FIG. 2 or the loop laying device 8 according to FIG. 3 in the machine as required.

Figure 4:
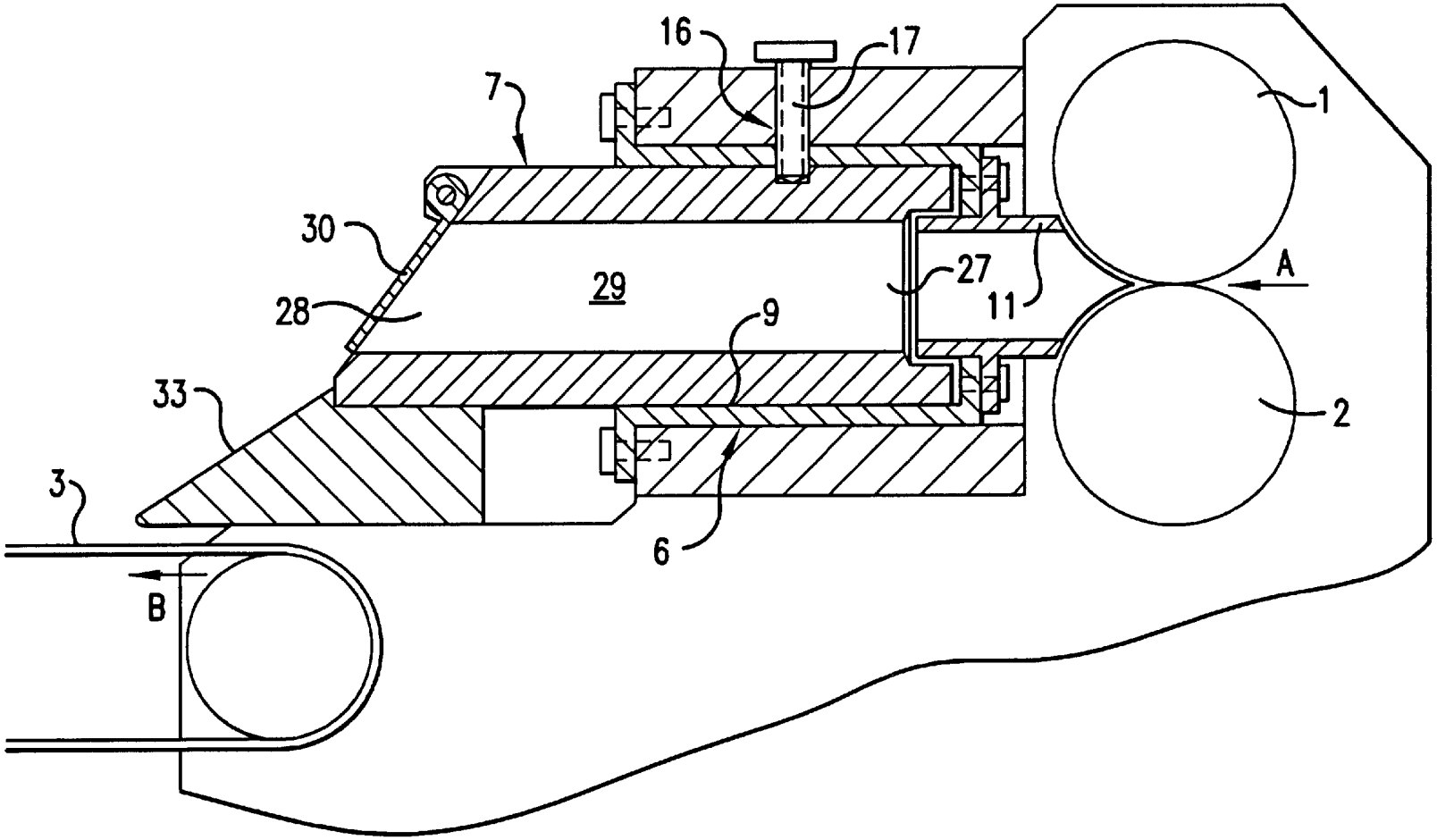
FIG. 4 is a longitudinal section according to FIG. 1, whereby the stuffer box is now inserted into the adapter.

It is shown in FIG. 4 how a stuffer box 7 is inserted into the hollow cylindrical take-up surface 9 of the adapter 6 and affixed there by means of the clamping screw 17 of the clamping device 16.

The thread (it can be more than one thread) fed by the delivery roller pair 1,2 in arrow direction A is fed through the longitudinal channel of the sealing extension 11 and then through the through channel 29 of the stuffer box 7, so that it can be deposited in the form of crimped thread loops directly downstream of the sliding surface 33 onto the transport belt 3 traveling in arrow direction B. It should be noted that the reference numbers of the Figures described above have been maintained, so that a repeat description is not necessary.

Figure 5:
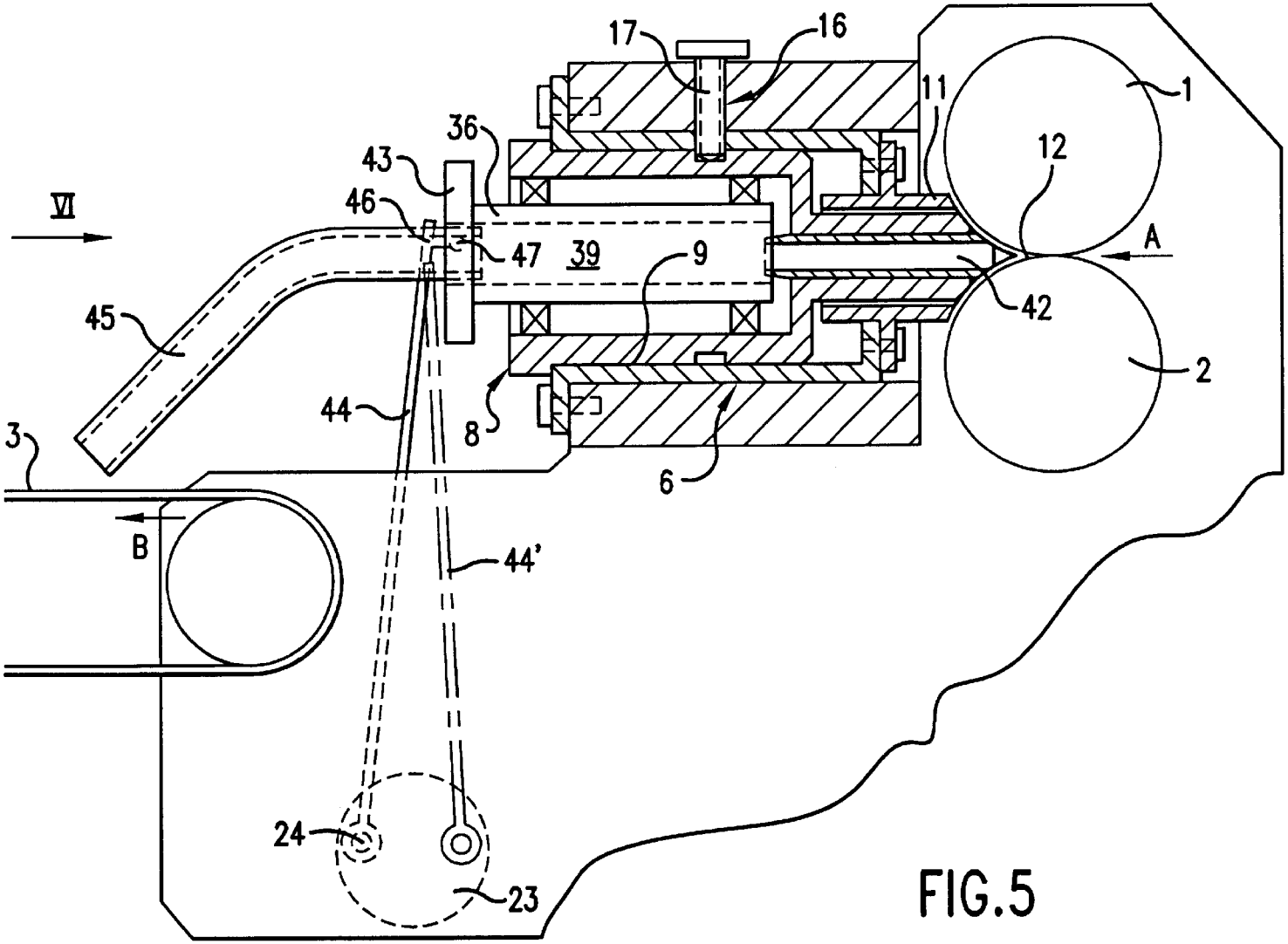
FIG. 5 is a longitudinal section according to FIG. 1, whereby the loop laying device is now inserted into the adapter.
Figure 6:
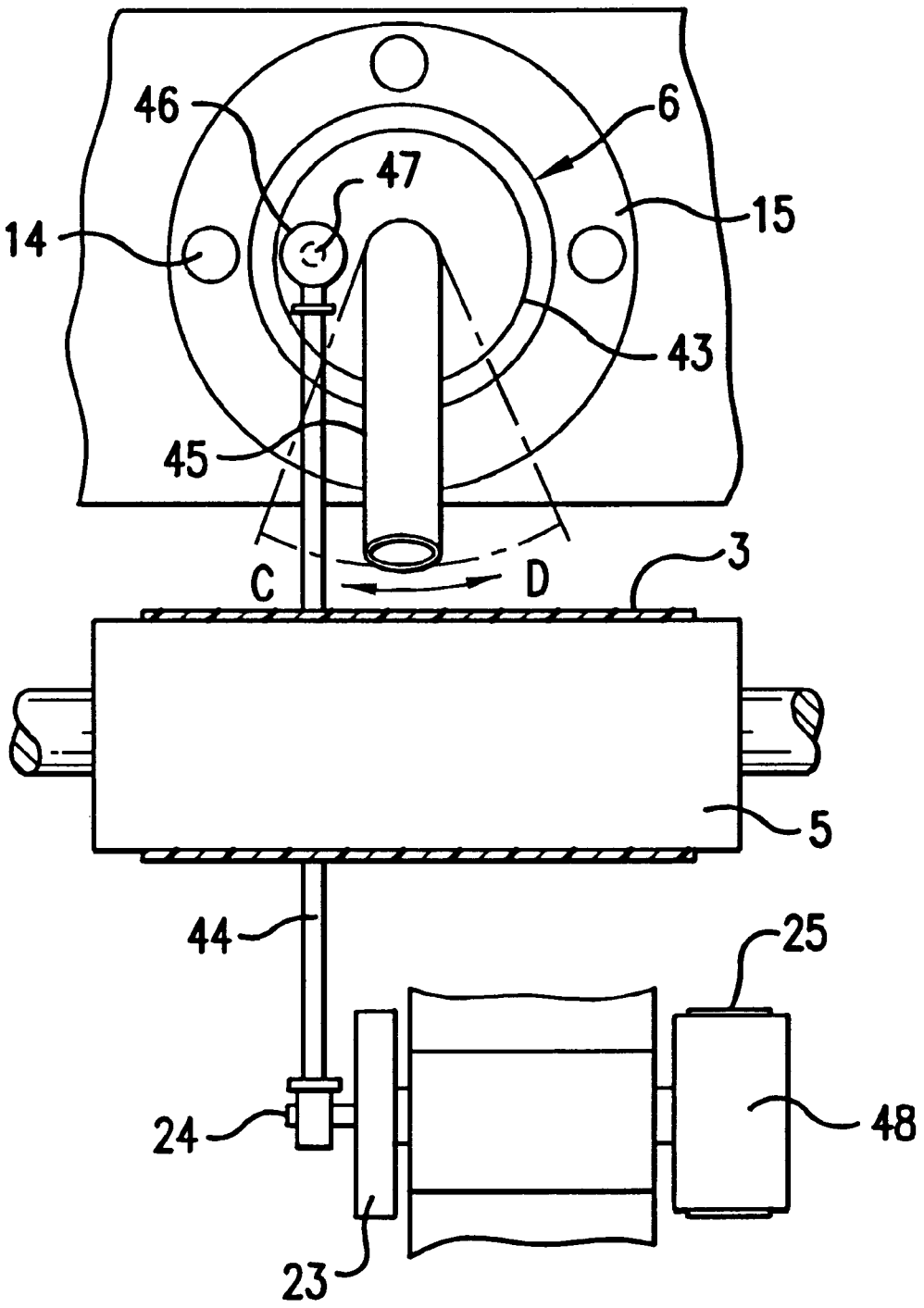
FIG. 6 is a view in the direction of arrow VI of FIG. 5.

As shown in FIGS. 5 and 6, an oscillating loop laying device 8 can be alternatively inserted—after the stuffer box 7 has been removed—into the hollow cylindrical take-up surface 9 of the adapter 6. It can be seen that the entry tube 42 is guided right into the wedge-shaped gap 12 of the delivery roller pair 1,2.

The traversing disc 43, which is connected to the hollow shaft 36, is connected by means of a connecting piece 46 and the traversing rod 44 with a connecting point 24 of the driving pulley 23. The driving pulley 23 rotates, while the traversing disc 43 only carries out traverse movements according to the arrow directions C-D (see FIG. 6). 44' denotes another position of the traversing rod 44.

As the traversing disc 43 and the driving pulley 23 are arranged with axles slightly inclined to one another, the connecting piece 46 is mounted by means of a socket joint 47 supported in the traversing disc 43.

The thread (it may also be a plurality of threads) delivered by the delivery roller pair 1,2 in arrow direction A is guided through the entry tube 42 into the through channel 39 and reaches the transport belt 3 by means of the channel of the deposit tube 45, on which transport belt 3 the thread is deposited in an order in the form of yarn loops.

The driving pulley 23 for the loop laying device 8 is connected with a drive disc 48 as shown in FIG. 6, in which the drive belt 25 mentioned above is disposed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims-and equivalents thereof.

What is claimed is:

1. A thread conditioning plant assembly comprising:

a conditioning plant machine frame, a delivery roller pair supported at the machine frame and operable to deliver at least one thread to be conditioned, an adapter fixed to the machine frame downstream of the delivery roller pair, said adapter including support surfaces for selectively supporting a thread stuffer box and a thread loop laying device to thereby accommodate changing operation of the conditioning plant assembly between stuff box operation and thread loop laying operation, and a flat transport belt disposed to accept thread from one of said stuffer box and looplaying device supported in the adaptor.

2. A thread conditioning plant-assembly according to claim 1, wherein the adapter includes a tubular member, and wherein the support surfaces are internal support surfaces formed on the tubular member.

3. A thread conditioning plant assembly according to claim 2, wherein the tubular member includes an extension which projects into a wedge-shaped gap of the delivery roller pair.

4. A thread conditioning plant assembly according to claim 2, wherein the tubular member is cylindrical.

5. A thread conditioning plant assembly according to claim 3, wherein the tubular member is cylindrical.

6. A thread conditioning plant assembly according to claim 1, wherein the adapter includes a selectively movable clamp selectively engageable to clamp the stuffer box and loop laying device in position on the machine frame.

7. A thread conditioning plant assembly according to claim 2, wherein the adapter includes a selectively movable clamping member supported in the tubular member and operable to selectively clamp the stuffer box and loop laying device in position in the tubular member.

8. A thread conditioning plant assembly according to claim 7, wherein the clamping member is a screw threaded member extending transversely of the tubular member and engaged with an outwardly facing surface of the one of the stuffer box and loop laying device inserted in the tubular member.

9. A thread conditioning plant assembly according to claim 6, wherein the adapter includes a cylindrical tubular member.

10. A thread conditioning plant assembly according to claim 7, wherein the tubular member is cylindrical.

11. A thread conditioning plant assembly according to claim 8, wherein the tubular member is cylindrical.

12. A thread conditioning plant assembly according to claim 1, comprising a central drive carried on the machine frame and operable to drive the delivery roller pair, wherein said central drive is further operably connected to drive the looping laying device when the loop laying device is supported at the adapter.

13. A thread conditioning plant assembly according to claim 2, comprising a central drive carried on the machine frame and operable to drive the delivery roller pair, wherein said central drive is further operably connected to drive the looping laying device when the loop laying device is supported at the adapter.

14. A thread conditioning plant assembly according to claim 3, comprising a central drive carried on the machine frame and operable to drive the delivery roller pair, wherein said central drive is further operably connected to drive the looping laying device when the loop laying device is supported at the adapter.

15. A thread conditioning plant assembly according to claim 4, comprising a central drive carried on the machine frame and operable to drive the delivery roller pair, wherein said central drive is further operably connected to drive the looping laying device when the loop laying device is supported at the adapter.

16. A thread conditioning plant assembly according to claim 5, comprising a central drive carried on the machine frame and operable to drive the delivery roller pair, wherein said central drive is further operably connected to drive the looping laying device when the loop laying device is supported at the adapter.

17. A thread conditioning plant assembly according to claim 6, comprising a central drive carried on the machine frame and operable to drive the delivery roller pair, wherein said central drive is further operably connected to drive the looping laying device when the loop laying device is supported at the adapter.

18. A thread conditioning plant assembly according to claim 7, comprising a central drive carried on the machine frame and operable to drive the delivery roller pair, wherein said central drive is further operably connected to drive the looping laying device when the loop laying device is supported at the adapter.

19. A thread conditioning plant assembly according to claim 8, comprising a central drive carried on the machine frame and operable to drive the delivery roller pair, wherein said central drive is further operably connected to drive the looping laying device when the loop laying device is supported at the adapter.

20. A thread conditioning plant assembly according to claim 9, comprising a central drive carried on the machine frame and operable to drive the delivery roller pair, wherein said central drive is further operably connected to drive the looping laying device when the loop laying device is supported at the adapter.

21. A thread conditioning plant assembly according to claim 10, comprising a central drive carried on the machine frame and operable to drive the delivery roller pair, wherein said central drive is further operably connected to drive the looping laying device when the loop laying device is supported at the adapter.

22. A thread conditioning plant assembly according to claim 3, wherein the extension is a tubular extension which is fixed to the tubular member and has a smaller cross sectional dimension than the tubular member.

23. A thread conditioning plant assembly according to claim 22, wherein the tubular extension is fixed to the tubular member by axially extending screw threaded members clamping radially extending flanges of the tubular member and the extension to one another.

24. A thread conditioning plant assembly according to claim 2, comprising a stuffer box having a stuffer box tubular member with external support surfaces which are adapted to slide into the tubular member and be supported on the internal support surfaces of the tubular member.

25. A thread conditioning plant assembly according to claim 2, comprising a loop laying device having a loop laying device tubular member with external support surfaces which are adapted to slide into the tubular member and be supported on the internal support surfaces of the tubular member.

26. A thread conditioning plant assembly according to claim 24, wherein the tubular member internal support surfaces and the stuffer box tubular member external support surfaces are cylindrical.

27. A thread conditioning plant assembly according to claim 25, wherein the tubular member internal support surfaces and the loop laying device tubular member external support surfaces are cylindrical.

28. A thread conditioning plant assembly according to claim 24, comprising a loop laying device having a loop laying device tubular member with external support surfaces which are adapted to slide into the tubular member and be supported on the internal support surfaces of the tubular member.

29. A thread conditioning plant assembly according to claim 28, wherein the stuffer box tubular member external support surfaces and the loop laying device tubular member external support surfaces are similar to one another and adapted to engage with corresponding tubular member internal support surfaces of the tubular member of the adapter.

30. A thread conditioning plant assembly comprising:

a conditioning plant machine frame, a delivery roller pair supported at the machine frame and operable to deliver at least one thread to be conditioned, and an adapter fixed to the machine frame downstream of the delivery roller pair, said adapter including a plurality of spaced support surfaces for selectively supporting a thread stuffer box and a thread loop laying device to thereby accommodate changing operation of the conditioning plant assembly between stuff box operation and thread loop laying operation.

* * * * *